US005828395A

United States Patent [19]

Takata

[11] Patent Number: 5,828,395

[45] Date of Patent: Oct. 27, 1998

[54] CONNECTING DEVICE BETWEEN INK SUPPLY SOURCE AND INK JET HEAD

[75] Inventor: Masayuki Takata, Nagoya, Japan

[73] Assignee: Brother Kogyo Kabushiki Kaisha, Nagoya, Japan

[21] Appl. No.: 719,078

[22] Filed: Sep. 24, 1996

[30] Foreign Application Priority Data

Sep. 29, 1995 [JP] Japan ..... 7-276907

[51] Int. Cl.[6] ..... B41G 2/175

[52] U.S. Cl. ..... 347/86; 347/93

[58] Field of Search ..... 347/86, 87, 93, 347/29, 30

[56] References Cited

U.S. PATENT DOCUMENTS 5,457,485 10/1995 Moriyama et al. .

FOREIGN PATENT DOCUMENTS

A-2-0609863 8/1994 European Pat. Off. .

2654-049 6/1978 Germany ..... 347/93

60-234848 11/1985 Japan ..... 347/93

A-5-330076 12/1993 Japan .

*Primary Examiner*—Benjamin R. Fuller

*Assistant Examiner*—Judy Nguyen

*Attorney, Agent, or Firm*—Oliff & Berridge, PLC

[57] ABSTRACT

In a connecting device for connecting an ink supply source and an ink jet head, a connecting member 16 connected with an ink cartridge 7 is provided with a needle member 17, a first and second ink guide paths 19 and 20, which communicate with one another, a filter 21 is disposed at a slant with the direction A of ink flowing in the first ink guide path 19. The velocity and the negative pressure of ink flow flowing along a filter face 21A of the filter 21 increase as the ink flows downward, and the velocity and the negative pressure of ink flow at a filter face 21B are contrary thereto. By utilizing this property, air bubble K generated at an ink supply operation to the ink jet head H is allowed to rapidly move downward along the filter face 21A, passed through the filter 21, and led to a second ink guide path 20.

17 Claims, 3 Drawing Sheets

CONNECTING DEVICE BETWEEN INK SUPPLY SOURCE AND INK JET HEAD

BACKGROUND OF THE INVENTION

1. Field of the Invention

The present invention relates to a connecting device in an ink jet printer,for connecting an ink supply source and an ink jet head to supply ink from the ink supply source to the ink jet head while removing dust and the like with a filter disposed in an ink guide path.

It relates especially to a connecting device, in connecting an ink supply source with an ink jet head, and, in performing an ink ejection recovery operation on the ink jet head, which can allow ink fluid to surely and promptly pass through a filter without the remains of air bubbles having entered or generated in the ink fluid around the filter at the ink supply source side in the ink guide path, thus enabling steady ink supply to the ink jet head without lowering the filtering efficiency of the filter, and also enabling the reduction of cost.

2. Description of Related Art

In ink jet printers, conventionally, in which ink droplets are selectively ejected from nozzles of an ink jet head to print various information on a print sheet, a connecting device is disposed between an ink cartridge and the ink jet head to supply ink to the ink jet head. This connecting device is generally provided with a filter for preventing fine-sized dust and the like contained in the ink from entering the ink jet head.

In the meantime, in the ink jet printer mentioned above, at the time of mounting an ink cartridge (for example, when first using the ink jet printer, when renewing the ink cartridge, and when remounting the ink cartridge once put away), air bubbles would enter between the ink cartridge and the filter disposed in the ink guide path of the connecting device. The air bubbles then come in contact with and stay on the filter during the ink supply to the ink jet head, causing the decrease in the effective filtering cross-section area of the filter. Accordingly, there will be a problem that an ink ejection failure occur unless air bubbles are eliminated from the ink guide path before the ejection of ink droplets.

To dissolve the above problem, there have been proposed connecting devices of various types to connect an ink cartridge and an ink jet head. For instance, in U.S. Pat. No. 5,457,485, disclosed is an ink jet recording apparatus comprising a filter disposed in an ink supply passage formed between a recording head and an ink tank, and a valve capable of firmly contacting to the filter to cover a part of the filter. In this ink jet recording apparatus, the valve is turned by relatively fast ink flow which is produced by a pump activated in the ink ejection recovery operation, covering a part of the filter, so that a large difference in pressure between an upstream and downstream sides of the filter is produced. As a result, air bubbles existing in the upstream side of the filter can pass through the filter and be eliminated therefrom.

Another prior art; European Patent Application Publication No. 609,863 discloses an ink jet recording apparatus including a connecting member provided with a first ink supply passage extending in parallel toward a print head unit and a second ink supply passage extending upwardly and communicating with the first ink supply passage, in which a filter member is provided horizontally within a tapered concave portion formed between a hollow needle communicating to the second ink supply path and the second ink supply passage.

In this recording apparatus, when ink is filled in the head unit after the ink tank is mounted on the apparatus, a suction pump is driven intervalically in a first suction mode to allow the ink fluid to smoothly pass through the filter member thereby to suppress the occurrence of air bubbles and to allow air bubbles generated to move along an inclined surface of the concave member toward the ink tank side in order to prevent the air bubbles from flowing into the print head unit, and then the suction pump is driven continuously in a second suction mode with the quantity and velocity of ink flow increased, so that the air bubbles remaining within the ink supply passage can be released out of the head unit.

According to the above mentioned ink jet recording apparatuses including a connecting device disposed between a recording head (head unit) and an ink tank, it is possible to efficiently eliminate air bubbles entered the ink supply passage and generated during ink supply operation from the ink tank to the recording head (head unit) when mounting the ink tank on the apparatus and when performing the ink ejection recovery operation on the recording head (head unit).

However, the former connecting device disclosed in U.S. Pat. No. 5,457,485 needs to have a valve which can come into contact firmly with the filter to cover a part of the filter in the ink supply passage. This makes its structure extremely complicated. As the valve is made opened and closed in response to the pressure differences of ink flow produced by a pump, fine control operation is required in opening and closing the valve, and therefore there is a case that the opening and closing operation of the valve can not be performed properly and smoothly.

Further, in the later connecting device disposed in European Patent Application Publication No. 609,863, as well as the former connecting apparatus, its purpose is substantially to prevent the occurrence of air bubbles. This is achieved by selectively actuating the suction pump in a first suction mode for driving it intervalically and in a second suction mode for driving it continuously, so that the suction pump produces the difference in the velocity of ink flow between both sides of the filter. In this connecting device, accordingly, the complicated control operation of the suction pump as mentioned above is required to eliminate air bubbles generated during ink supply from the ink tank after mounted on the apparatus to the head unit, and hence air bubbles are unable to be removed rapidly. It also causes the increase of the cost of the recording apparatus.

In the connecting device, furthermore, the filter member is disposed perpendicularly to the direction of ink fluid flowing from the hollow needle to the second ink supply passage. In such a state, formed is a meniscus of ink fluid existing in an ink passing area of the filter member, so that air bubbles generated as above could not pass easily through the filter due to the meniscus holding power. Therefore, to allow the air bubbles to smoothly and rapidly pass through the filter, a larger negative pressure is required and a large-sized suction pump needs installing accordingly.

SUMMARY OF THE INVENTION

The present invention has been made in view of the above circumstances and has an object to overcome the above problems and to provide a connecting device without requiring a complicated control operation and, when an ink supply source is connected with an ink jet head and when ejection recovery operation is performed on the ink jet head, which can allow air bubbles to pass through a filter rapidly and surely without allowing the air bubbles entered within an ink guide path and occurred within an ink supply passage to stay in an ink supply source side, thus enabling steady ink supply to the ink jet head without lowering the filtering efficiency of the filter.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a connecting device for connecting an ink supply source and an ink jet head of this invention comprises an ink guide path for leading ink flow from the ink supply source to the ink jet head; and a filter member disposed at a slant plane with respect to a direction of the ink flow in the ink guide path.

The ink supply source may be an ink cartridge detachably mounted to the ink jet head, and the ink guide path is formed in a connecting member one end portion of which is removably coupled with an ink supply hole of the ink cartridge.

The connecting member may have a hollow needle member at one end, which is fitted in the ink supply hole of the ink cartridge.

The connecting member may comprise a first member having a first slant surface and a second member having a second slant surface, both the first and the second slant surfaces contacting each other and defining the slant plane where the filter member is disposed.

The filter member may be disposed between the first and the second slant surfaces.

The ink guide path may include a first path which is normally formed in the connecting member and a second path which is horizontally formed in the connecting member continuously to the second path.

The filter member may be disposed in the first path so as to slant against the ink flow therein.

The connecting device may further comprise suction means for sucking air bubbles occurring in the ink guide path, the suction means sucking the air bubbles through the ink jet head.

The filter member may be disposed in the first path so that sectional area of the first path gradually becomes narrow along the direction of the ink flow at a first side of the filter member corresponding to the ink cartridge, thereby the ink flow gradually becomes fast and negative pressure produced by the suction means gradually becomes high.

The air bubbles may pass through the filter member at lower part thereof to a second side of the filter member opposite the first side when sucked by the suction means.

The filter member may be formed of SUS fine wires by twill weaving.

According to the connecting device constructed as above, when an ink supply source is coupled with an ink jet head, both communicate with each other through an ink guide path, it enabling an ink supply operation from the ink supply source to the ink jet head. Air bubbles entered and generated in ink fluid within the ink guide path at this time stay on a filter at an ink supply source side when ink is supplied from the ink supply source to the ink jet head due to the suction by a pump and the like.

Even in an ink ejection recovery operation on the ink jet head, air bubbles generated in the ink guide path sometimes stay on the filter member at an ink supply source side during the suction of ink by the pump and the like.

The filter member being disposed at a slant with respect to the direction of ink flowing in an ink guide path, the velocity of ink flow gradually increases as the ink fluid flows downward along a filter face at the ink supply source side, simultaneously the negative pressure produced by the suction by a pump gradually increases.

Accordingly, the air bubble generated as above moves along the slanting filter face while increasing the moving speed as the velocity of ink flow increases, finally passing through the filter member at a position where the negative pressure is so large as to correspond to the size of the air bubble. After that, the air bubble is carried away toward the ink jet head. As a result, the air bubble can surely and rapidly be eliminated and hence does not remain near the filter member at an ink supply source side in the ink guide path.

In this way, no air bubble remaining near the filter member at its ink supply source side, it is possible to steady supply ink to the ink jet head without lowering the filtering efficiency of the filter member.

Especially, the ink supply source is constructed of an ink cartridge which can be mounted on and put away from the ink jet head, the ink supply hole of the ink cartridge is connected with the connecting member defining the ink supply path so as to be removable therefrom. This connection is achieved by engaging the hollow needle member formed at one end portion of the connecting member to the ink supply hole of the ink cartridge.

As inserted between both slanting faces of two connecting members forming the ink guide path, the filter member can easily be disposed at a slant with respect to the direction of ink flowing without needing special parts.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings.

DETAILED DESCRIPTION OF THE PREFERRED EMBODIMENTS

A detailed description of one preferred embodiment of a connecting device for connecting an ink supply source and an ink jet head embodying the present invention will now be given referring to the accompanying drawings.

At first, the schematic structure of the ink jet printer in which a connecting device of the present invention is mounted will be explained with reference to FIG. 1.

Figure 1:
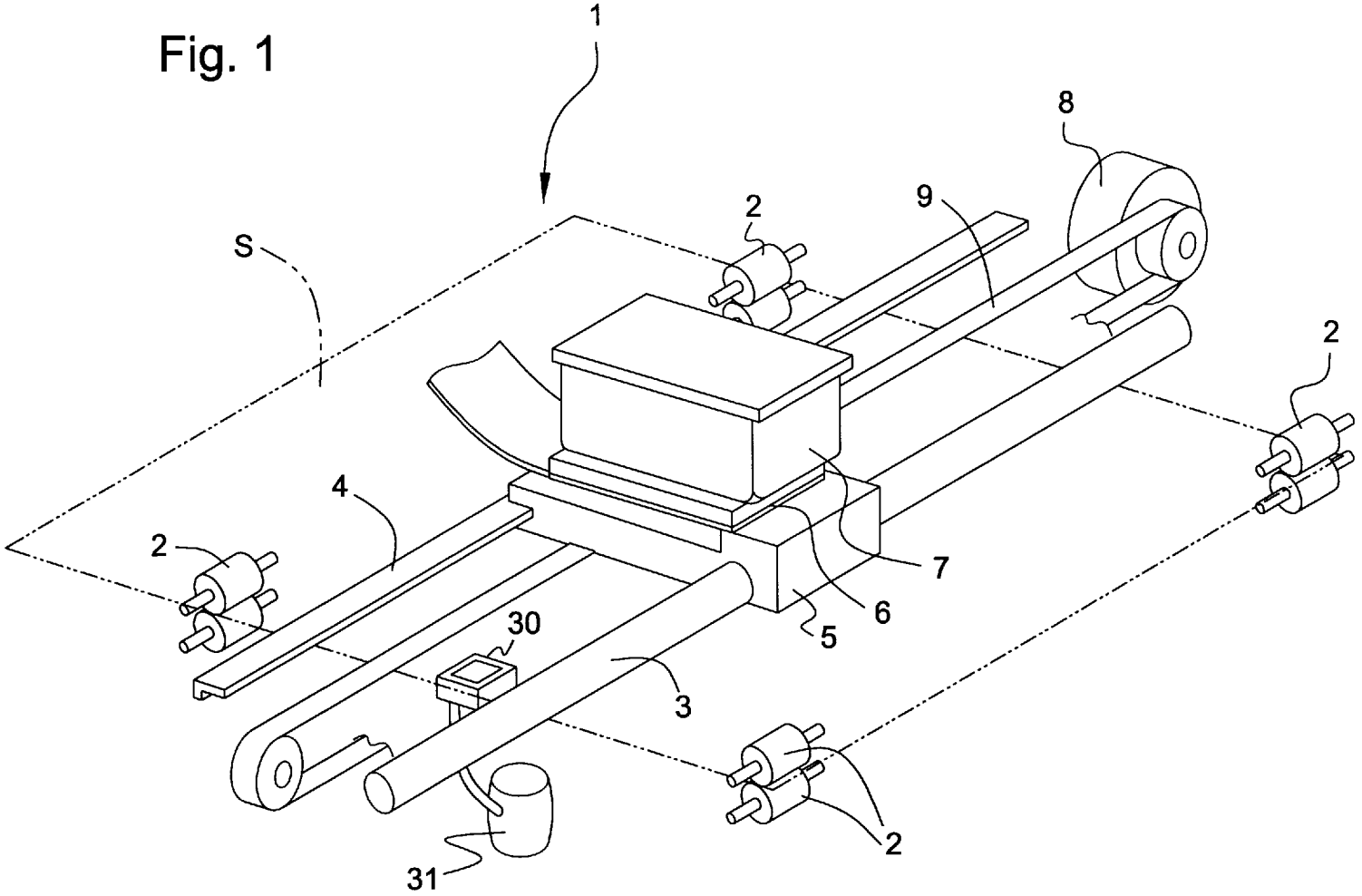
FIG. 1 is a schematic perspective view of an ink jet printer.

FIG. 1 is a schematic perspective view of the ink jet printer.

In FIG. 1, an ink jet printer 1 has a feeding mechanism for feeding a recording sheet, for example, a printing paper S by means of a plurality of a couple of rollers 2 and a carriage mechanism for moving an ink jet head H (see FIG. 2) along a recording area on the printing paper S in a perpendicular direction with respect to the feeding direction. This carriage mechanism includes a carriage 5 supported on a guide rod 3 and a guide rail 4 so as to be slidable thereon. The guide rod 3 and the guide rail 4 both are disposed in parallel to the printing paper S. On the carriage 5 are removably mounted a head unit 6 and an ink cartridge 7 serving as an ink supply source. On the head unit 6, an ink jet head H is provided so that ink jet nozzles formed on the ink jet head H are arranged so as to eject ink downward, in other words, so that ink ejecting orifices of the ink jet nozzles face against the printing paper S. With the ink jet head H, ink droplets are ejected through the ink jet nozzles on the printing paper S to print the same. The carriage 5 is activated through a belt 9 by a CR motor 8. In a non-printing area is installed a well-known recovery unit constructed of a cap 30 which can come in contact with and detach from the ink jet head H and a suction pump 31 for sucking ink from the head H through the cap 30 being in contact with the head H.

Next, the connecting device for connecting the ink cartridge 7 and the ink jet head H will be explained in reference to FIG. 2.

Figure 2:
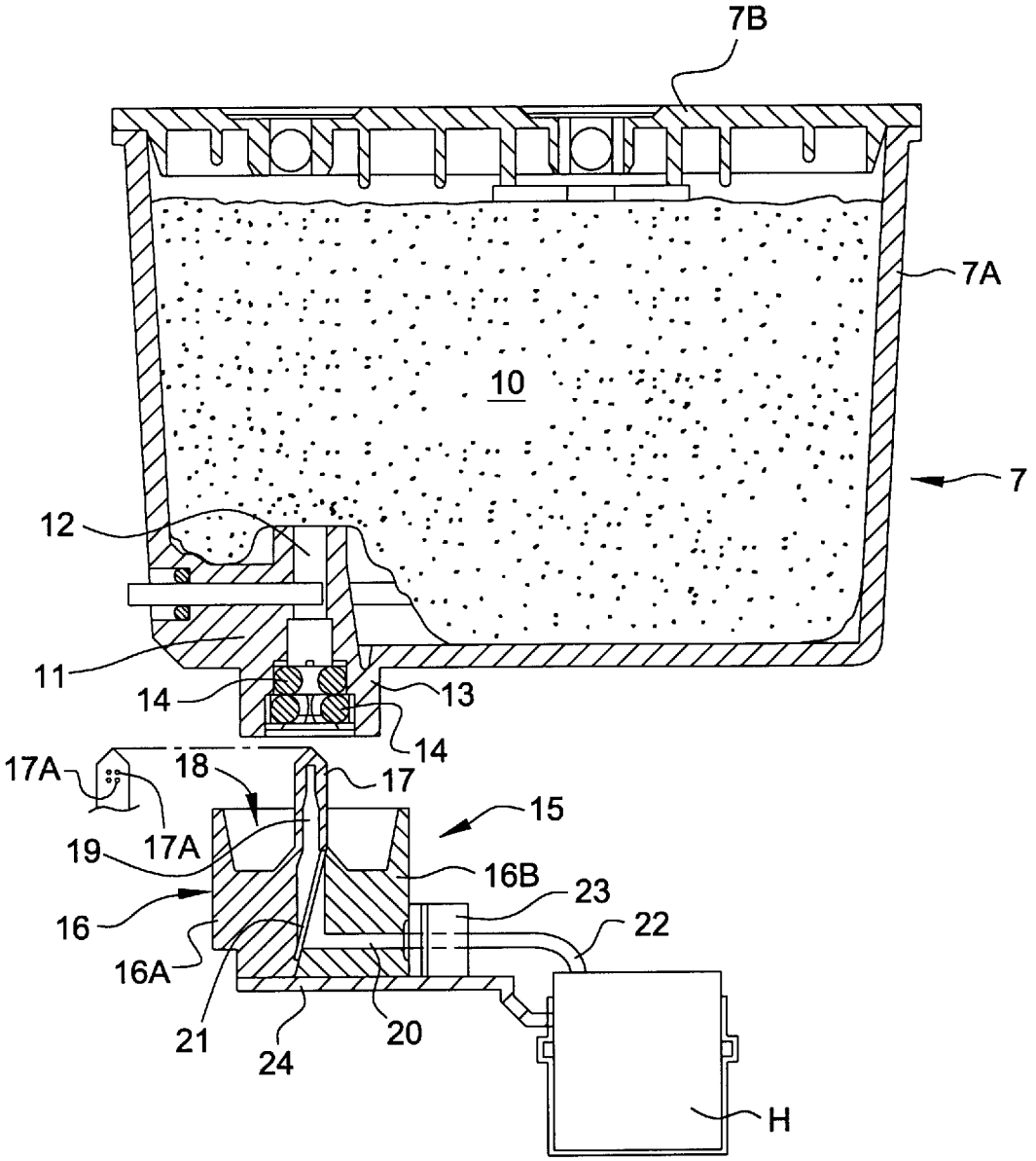
FIG. 2 is a schematic sectional view of an ink cartridge and an ink jet head which are connected via a connecting device.

FIG. 2 is a schematic sectional view of the connecting device. In FIG. 2, a part of the head unit 6 is shown and a carriage 5 is omitted. The ink jet head H is secured in a head holding opening (not shown) formed in the carriage 5.

In FIG. 2, the ink cartridge 7 is constructed of a cartridge container 7A and a cap 7B fitted on the upper end portion of the container 7A by welding. Within the container 7A is accommodated a porous member 10 impregnated with ink. At the bottom face of the cartridge container 7A, at a left side in the drawing, an ink supply part 11 is formed. This ink supply part 11 is provided with an ink supply hole 12 with a diameter gradually widened in a downward direction. The ink supply hole 12 communicates at its end to a cylindrical engagement portion 13 protruding downward from the bottom face of the cartridge container 7A. In the cylindrical engagement portion 13, as mentioned later, a hollow needle member 17 of a connecting device 15 is to be fitted. The cylindrical engagement portion 13 is provided with two O-rings 14 on the inner wall to air-tightly hold the needle member 17.

The connecting device 15 includes a connecting member 16 formed of a first connecting member 16A and a second connecting member 16B which are fixedly assembled with each other. This connecting member 16 is integrally provided with a hollow needle member 17 having a plurality of pores 17A (four pores are shown in FIG. 2) through each of which ink is directed into the connecting member 16. Around the needle member 17 is formed a circular concave portion 18 in which the cylindrical engagement portion 13 can be held in engaging with the needle member 17 of the ink cartridge 7.

The connecting member 16, furthermore, is provided with a first ink guide path 19 directing vertically and subsequently to the needle member 17, and a second ink guide path 20 directing horizontally and communicating with the first ink guide path 19. Within the first ink guide path 19, a filter 21 is disposed at a slant with respect to the first ink guide path 19 extending in a vertical direction. The filter 21 is formed of SUS fine wires by twill weaving, and it is installed in the first guide path 19 at the time of fixedly assembling the first and second connecting members 16A and 16B.

The first and second connecting members 16A and 16B before assembled are separated at a surface 16C slanting to an ink flow direction (see FIG. 3) and, accordingly, the filter 21 is inserted between both slanting faces 16c of the first and second connecting members 16A and 16B.

To the right end portion of the second ink guide path 20, a tube 22 is coupled and fixed with a fixing member 23 made from rubber. Another end portion of the tube 20 is connected to the ink jet head H. With the construction of the connecting device 15, the ink impregnated in the porous member 10 within the ink cartridge 7 is supplied via the ink supply hole 12, the needle member 17, the first ink guide path 19, the filter 21, the second ink guide path 20, and the tube 22 to each nozzles of the ink jet head H. The connecting member 16 and the fixing member 23 both are fixedly mounted on a support plate 24 formed integrally with the ink jet head H.

Next, operation to eliminate air bubbles entering and generating in ink fluid when the ink cartridge 7 is mounted on the ink jet printer 1 will be described, referring to FIG. 3.

Figure 3:
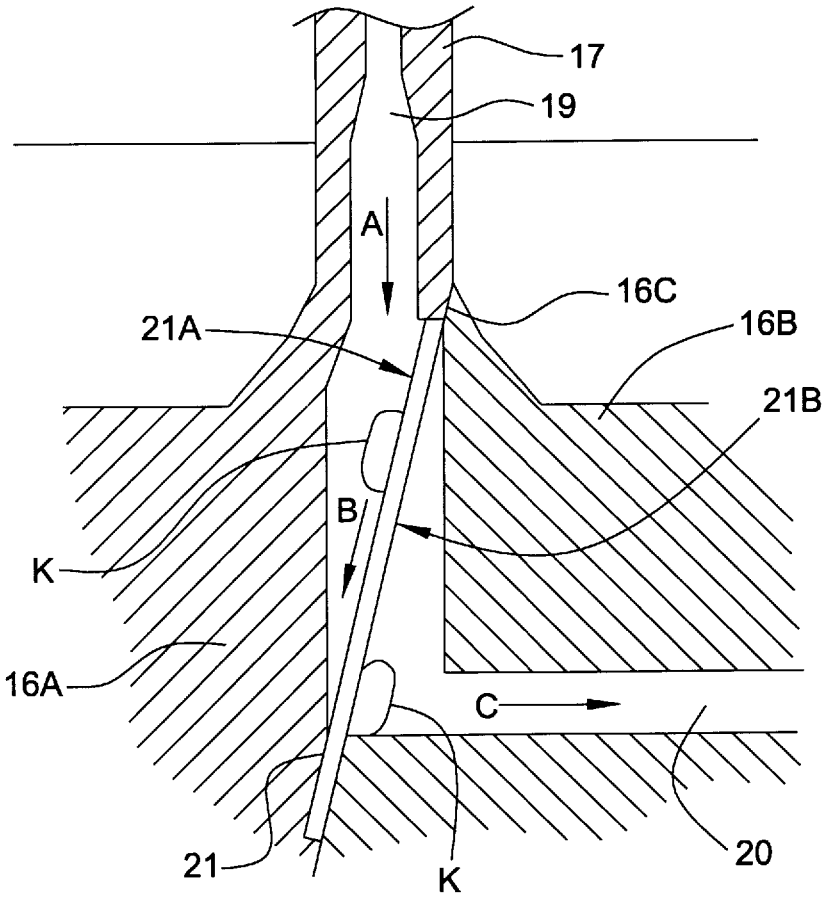
FIG. 3 is a schematic sectional view of a first ink guide path of the connecting device.

FIG. 3 is a schematic enlarged sectional view of a part of the connecting member 16 including the first ink guide path 19.

To mount the ink cartridge 7 on the ink jet printer 1, generally, at the time of first using the ink jet printer 1, of renewing the ink cartridge 7, and of re-using the ink cartridge 7 after once detached, the ink cartridge 7 is fixed on the connecting member 16 by engaging the needle member 17 of the connecting member 16 into the engagement portion 13. When ink is supplied from a new ink cartridge 7 mounted to the ink jet head H, the ink jet head H is moved at first in a position facing against the cap 30 and then the suction pump 31 is driven to suck ink fluid through the ink jet orifices from the ink jet head H. At this time, the porous member 10, the ink supply hole 12, and the needle member 17 contain air therein respectively, thus possibly causing air bubbles to generate and stay in the ink fluid in the first ink guide path 19 during the ink supply operation. It is therefore necessary to remove the air bubbles therefrom.

Accordingly, the air bubbles generated in the first ink guide path 19 as mentioned above will be sucked downward at the ink suction operation. The filter 21 is disposed, as shown in FIG. 3, in the first ink guide path 19 so as to be slant with respect to a direction of the ink flow indicated by an arrow A. Here, in the upstream side of the filter 21, the sectional area of the ink guide path 19 gradually decreases in a downward direction along a filter face 21A, i.e., the ink guide path 19 becomes narrow downwards, so that the velocity of ink flow gradually increases in proportion to the sectional area of the ink guide path 19 and also the negative pressure due to the suction force of the suction pump gradually increases.

As a result, air bubble K generated as mentioned above is moved on the slanting filter face 21A along an arrow B during the ink suction operation by the suction pump, with its moving velocity gradually increasing in proportion to the velocity of the ink flow. Then the air bubble K is allowed to pass through the filter 21 at a position where the negative pressure produced is so large as to correspond to the size of air bubble K, flowing in the second ink guide path 20.

In the downstream side of the filter 21, contrary to the case of the filter face 21A side, the velocity of ink flow increases as the ink fluid flows downward along the filter face 21B, and the negative pressure increases at the same time. Due to the ink flow with a large velocity, the air bubble K passed through the filter 21 as mentioned above is carried in a direction indicated by an arrow C and smoothly leaded to the second ink guide path 20.

In this way, the air bubble K does not stay on the filter at its ink cartridge side in the first ink guide path 19, and is allowed to surely and rapidly pass through the filter 21. The air bubble K after passed through the filter 21 is finally sucked together with ink fluid through the second ink guide path 20 by a pump 31. Because of the suction operation by the pump 31, air bubbles do not remain near the filter face 21A as mentioned above, so that the filtering efficiency of the filter 21 is not made lowered, enabling steady ink supply to the ink jet head H. For ink recovery of the head H, substantially the same operation as above will be performed.

As described above, in the connecting device 15, the connecting member 16 to be coupled with the ink cartridge 7 is provided with the hollow needle member 17, the first and second ink guide paths 19 and 20, which are communicated with one another, wherein the filter 21 is disposed at a slant with respect to the direction A of the ink flow in the first ink guide path 19. The velocity and negative pressure of the ink fluid flowing along the filter face 21A increase as the ink fluid flows downward, in other words, as the cross-sectional area of the ink path 19 is reduced at the ink cartridge side of the filter 21.

To the contrary, at the filter face 21B side, the velocity and negative pressure of ink fluid increase downward along the filter face 21B. By effectively using this property, the above device is constructed so that air bubbles generated during the ink supply to the ink jet head H can fast be moved downward along the filter face 21A, passed through the filter 21 at its lower part, and led to the second path 20.

Consequently, without requiring complicated control operation to remove air bubbles, air bubbles can be allowed to surely and rapidly pass through the filter 21, and hence no air bubble remains near the filter 21 at its ink cartridge side in the first path 19. Due to no air bubble remaining near the filter 21 at the ink cartridge side, the filtering efficiency of the filter 21 is preventing from lowering. As a result, steady ink supply to the head H can be achieved.

The present invention may be embodied in other specific forms without departing from the spirit or essential characteristics thereof.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A connecting device for use in an ink jet printer having suction means for sucking ink from an ink cartridge to an ink jet head by negative pressure produced by the suction means, the device conveying ink along with any air bubbles occurring in the ink, under negative pressure from the ink cartridge, through a filter member, to the ink jet head so as to avoid any collection of air bubbles at the filter member, the device comprising a connecting member arranged between the ink cartridge and the ink jet head, the connecting member having:

an ink guide path having a predetermined sectional area for leading ink flow from the ink cartridge to the ink jet head; and said filter member having a first side facing the ink cartridge and a second side opposite to the first side, disposed obliquely in the ink guide path with respect to a direction of the ink flow, wherein the ink guide path includes a first path formed on an upstream ink flow side of the filter member and a second path formed on a downstream ink flow side of the filter member;

wherein the sectional area of the first path along the direction of the ink flow at the first side of the filter member gradually becomes narrow; and wherein the air bubbles in the ink guide path pass through the filter member from the first side to the second side when sucked by the suction means.

2. The connecting device according to claim 1, wherein the connecting member has a one end portion including coupling means for detachably coupling the ink guide path of the connecting member with the ink cartridge.

3. The connecting device according to claim 2, wherein said coupling means includes a hollow needle member for coupling the ink guide path of the connecting member with the ink cartridge having an ink supply hole, such that the hollow needle member fits into the ink supply hole.

4. The connecting device according to claim 1, wherein the connecting member comprises a first member having a first slant surface and a second member having a second slant surface, the first slant surface and the second slant surface contacting each other.

5. The connecting device according to claim 4, wherein the filter member is obliquely disposed between the first slant surface and the second slant surface.

6. The connecting device according to claim 1, wherein the ink guide path includes a third path, a longitudinal direction of the first path and the second path is continuous with the filter member disposed therebetween, and the longitudinal direction of the first path and the second path is perpendicular to a longitudinal direction of the third path.

7. The connecting device according to claim 6, wherein the filter member is disposed between the first path and the second path at an oblique angle to the ink flow therein.

8. The connecting device according to claim 7, wherein the air bubbles pass through the filter member at lower part thereof to the second side of the filter member when sucked by the suction means.

9. The connecting device according to claim 8, wherein the sectional area of the first path is narrower at the lower part of the filter member than at the upper part of the filter member.

10. The connecting device according to claim 1, wherein the filter member is formed of SUS fine wires by twill weaving.

11. The connecting device according to claim 6, wherein the ink guide path is bent in the connecting member to form a corner and the filter member has a lower end.

12. The connecting device according to claim 11, wherein the filter member is obliquely disposed to position the lower end at the corner of the ink guide path.

13. A connecting device for use in an ink jet printer having suction means for sucking ink from an ink cartridge to an ink jet head by negative pressure produced by the suction means, the device conveying ink along with any air bubbles occurring in the ink, under negative pressure from the ink cartridge, through a filter member, to the ink jet head so as to avoid any collection of air bubbles at the filter member, the device comprising:

a connecting member arranged between the ink cartridge and the ink jet head, the connecting member having an ink guide path having a predetermined sectional area for leading ink flow from the ink cartridge to the ink jet head and said filter member disposed obliquely in the ink guide path with respect to a direction of the ink flow, the filter member having a first side corresponding to the ink cartridge and a second side opposite to the first side, wherein the ink guide path has a first path at the first side and a second path at the second side, wherein the sectional area of the first path along the direction of the ink flow at the first side of the filter member gradually becomes narrow, and the air bubbles in the ink guide path pass through the filter member from the first side to the second side when sucked by the suction means.

14. The connecting device according to claim 13, wherein the ink guide path includes a third path, a longitudinal direction of the first path and the second path is continuous with the filter member disposed therebetween, and the longitudinal direction of the first path and the second path is perpendicular to a longitudinal direction of the third path.

15. The connecting device according to claim 14, wherein the filter member is obliquely disposed in the first path against the ink flow therein.

16. The connecting device according to claim 14, wherein the ink guide path is bent in the connecting member to form a corner and the filter member has a lower end.

17. The connecting device according to claim 16, wherein the filter member is obliquely disposed to position the lower end at the corner of the ink guide path.

* * * * *